US006569016B1

(12) United States Patent
Baerlocher

(10) Patent No.: US 6,569,016 B1
(45) Date of Patent: May 27, 2003

(54) GAMING DEVICE HAVING A METHOD FOR RANDOMLY GENERATING A BONUS ROUND OUTCOME

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 210 days.

(21) Appl. No.: 09/679,251

(22) Filed: Oct. 4, 2000

(51) Int. Cl.[7] ..... A63F 9/24
(52) U.S. Cl. ..... 463/16
(58) Field of Search ..... 463/20–16, 21, 463/22, 25–28; 273/143 R

(56) References Cited

U.S. PATENT DOCUMENTS

| | | | | |
|---|---|---|---|---|
| 4,624,459 | A | | 11/1986 | Kaufman |
| 4,756,531 | A | * | 7/1988 | DiRe et al. |
| 4,836,546 | A | * | 6/1989 | DiRe et al. |
| 5,342,047 | A | | 8/1994 | Heidel et al. |
| 5,456,465 | A | | 10/1995 | Durham |
| 5,524,888 | A | | 6/1996 | Heidel |
| 5,873,781 | A | | 2/1999 | Keane |
| 5,984,781 | A | | 11/1999 | Sunaga |
| 6,033,307 | A | | 3/2000 | Vancura |
| 6,059,289 | A | | 5/2000 | Vancura |
| 6,102,798 | A | | 8/2000 | Bennett |
| 6,142,874 | A | | 11/2000 | Kodachi |
| 6,146,273 | A | * | 11/2000 | Olsen |
| 6,155,925 | A | * | 12/2000 | Giobbi et al. |
| 6,159,097 | A | * | 12/2000 | Gura |
| 6,190,255 | B1 | * | 2/2001 | Thomas et al. |
| 6,203,429 | B1 | * | 3/2001 | Demar et al. |
| 6,334,814 | B1 | * | 1/2002 | Adams |

FOREIGN PATENT DOCUMENTS

| | | |
|---|---|---|
| EP | 0945837 A2 | 9/1999 |
| WO | WO 00/12186 | 3/2000 |

OTHER PUBLICATIONS

Keno Brochure written by Flamingo Reno, published prior to 2000.

Winning Bid published by WMS Gaming, Inc.

Texas Tea Brochure and Article published by IGT in 2000.

* cited by examiner

*Primary Examiner*—Michael O'Neill
(74) *Attorney, Agent, or Firm*—Bell, Boyd & Lloyd LLC

(57) ABSTRACT

The method of the gaming device of the present invention contains a plurality of awards each having a value, a plurality of activators, a plurality of deactivators, and a set of indicators from which the activators and deactivators are chosen. The activators, deactivators and indicators are numbers. The controller of the gaming device randomly selects one of the indicators. If the plurality of activators includes the selected indicator, the player receives the value of an award. Conversely, if the plurality of deactivators includes the selected indicator, the player does not receive the value of an award. If the plurality of activators or deactivators is sequential, e.g. 1 through 5, the activator set or deactivator set can include a selected integer, for example 3, or a non-integer, for example 3.5. The implementor of the gaming device may predetermine the activators and deactivators or may add another layer of random generation, whereby the gaming device randomly selects the activators and deactivators from the set of indicators. In either case, the implementor can set the probability of success for each award to be any probability, 0 through 100%.

34 Claims, 9 Drawing Sheets

FIG.4

| AWARD | INDICATORS | ACTIVATORS | DEACTIVATORS |
|---|---|---|---|
| 2x | 0,1,2,3,4,5,6,7,8,9 | 0,1,2,3 | 4,5,6,7,8,9 |
| 3x | 0,1,2,3,4,5,6,7,8,9 | 0,1,2 | 3,4,5,6,7,8,9 |
| 4x | 0,1,2,3,4,5,6,7,8,9 | 0,1 | 2,3,4,5,6,7,8,9 |
| 5x | 0,1,2,3,4,5,6,7,8,9 | 0,1,2,3,4 | 5,6,7,8,9 |
| 10x | 0,1,2,3,4,5,6,7,8,9 | 0,1,2,3,4,5 | 6,7,8,9 |
| 25x | 0,1,2,3,4,5,6,7,8,9 | 0,2,4,6,8 | 1,3,5,7,9 |
| 30x | 0,1,2,3,4,5,6,7,8,9 | 1,3,5,7 | 0,2,4,6,8,9 |
| 45x | 0,1,2,3,4,5,6,7,8,9 | 7,8,9 | 0,1,2,3,4,5,6 |
| 50x | 0,1,2,3,4,5,6,7,8,9 | 6 | 0,1,2,3,4,5,7,8,9 |

68 66 72 74 78

FIG.5

| AWARD | ACTIVATOR PROBABILITY | INDICATORS | ACTIVATORS | DEACTIVATOR PROBABILITY | DEACTIVATORS |
|---|---|---|---|---|---|
| 2x | 40% | 0,1,2,3,4,5,6,7,8,9 | 0,1,2,3 | 60% | 4,5,6,7,8,9 |
| 3x | 30% | 0,1,2,3,4,5,6,7,8,9 | 0,1,2 | 70% | 3,4,5,6,7,8,9 |
| 4x | 20% | 0,1,2,3,4,5,6,7,8,9 | 0,1 | 80% | 2,3,4,5,6,7,8,9 |
| 5x | 50% | 0,1,2,3,4,5,6,7,8,9 | 0,1,2,3,4 | 50% | 5,6,7,8,9 |
| 10x | 60% | 0,1,2,3,4,5,6,7,8,9 | 0,1,2,3,4,5 | 40% | 6,7,8,9 |
| 25x | 50% | 0,1,2,3,4,5,6,7,8,9 | 0,2,4,6,8 | 50% | 1,3,5,7,9 |
| 30x | 40% | 0,1,2,3,4,5,6,7,8,9 | 1,3,5,7 | 60% | 0,2,4,6,8,9 |
| 45x | 30% | 0,1,2,3,4,5,6,7,8,9 | 7,8,9 | 70% | 0,1,2,3,4,5,6 |
| 50x | 10% | 0,1,2,3,4,5,6,7,8,9 | 6 | 90% | 0,1,2,3,4,5,7,8,9 |

68 66 70 72 74 76 78

FIG.6A

| AWARD | SELECTED INDICATOR |
|---|---|
| 2x | 7 |
| 3x | 1 |
| 4x | 2 |
| 5x | 7 |
| 10x | 5 |
| 25x | 4 |
| 30x | 9 |
| 45x | 8 |
| 50x | 0 |

80

66

68

FIG.6B

| AWARD | SELECTED INDICATOR |
|---|---|
| 2x | 7.5 |
| 3x | 1.5 |
| 4x | 2.3 |
| 5x | 7.9 |
| 10x | 5.1 |
| 25x | 4.8 |
| 30x | 9.4 |
| 45x | 8.3 |
| 50x | 0 |

80

66

68

GAMING DEVICE HAVING A METHOD FOR RANDOMLY GENERATING A BONUS ROUND OUTCOME

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device with a bonus round, wherein the gaming device randomly generates the outcome each time the player enters the bonus round.

BACKGROUND OF THE INVENTION

Gaming machines currently exist with bonus schemes in which a player has one or more opportunities to choose masked bonus awards from a group of symbols arranged in a pattern and displayed to the player. When the player chooses a masked symbol from the pattern, the bonus scheme removes the mask and either displays a bonus value or a bonus round terminator, which terminates the bonus round. The controller of the gaming machine randomly places a predetermined number of bonus rounds awards and bonus terminators in the pattern at the beginning of the bonus round and maintains the positioning until the bonus round terminates. The outcome depends upon whether the player selects an award or terminator.

European Patent Application No. EP 0 945 837 A2 which is assigned on its face to WMS Gaming, Inc. discloses a bonus scheme of this type. In this type of scheme, each time the player enters the bonus round, the player has the same diminishing chance to select an award instead of a terminator. For example, the WMS Gaming, Inc. application discloses a bonus scheme that has 30 possible selections, 24 bonus awards and 6 bonus round terminators. Each time the player enters the bonus round, the player has a 100% chance of having a first pick, an 80% chance of having a second pick, a 63% chance of having a third pick, a 50% chance of having a fourth pick and so on. On average, this bonus round will continue for four selections.

It is desirable to provide players with new bonus schemes that have multiple layers, multiple variables, and multiple schemes that determine the player's success in a bonus round. In a bonus round having multiple layers or schemes, it is desirable to have a method or tool whereby the gaming device or controller randomly determines the bonus outcome, as opposed to or in addition to the player determining the outcome. One useful aspect of such a method is to have an instantaneous random outcome, rather than requiring time consuming player interface. Another such aspect is to add a layer of random generation to the one that the player creates when the player randomly selects one of a plurality of masked symbols. That is, upon the player's random selection of a symbol, the game randomly generates an outcome. The outcome is not predetermined.

It is also desirable to create a random generation scheme in which an implementor predetermines the probability of an outcome. For example, an implementor may desire that there be two possible outcomes for a particular selection, X and Y. The implementor may also desire that there exist a probability that the game will award either X or Y. For example, the implementor may desire there to be a 40% chance that the game selects the outcome X and a 60% chance that the game selects the outcome Y. It is desirable to have a method which enables the game to choose one of a plurality of outcomes based upon a set of predetermined probabilities.

SUMMARY OF THE INVENTION

The present invention provides a gaming device having a bonus scheme or method for randomly generating a bonus round outcome. It should be appreciated that the method of the present invention can be employed as a component of a multi-layered bonus scheme or method, in a bonus game within a master game having a plurality of bonus games, or in any combination thereof.

The present invention contains a plurality of awards each having a value associated therewith, a plurality of activators associated therewith, a plurality of deactivators associated therewith, and a set of indicators associated therewith from which the activators and deactivators are chosen. The activators, deactivators and indicators are preferably numbers. The controller of the gaming device randomly selects one of the indicators. If the plurality of activators includes the selected indicator, the player receives the value of an award. Conversely, if the plurality of deactivators includes the selected indicator, the player does not receive the value of an award. If the plurality of activators or deactivators is sequential or a range, e.g. 1 through 5, the plurality of activators and deactivators can include a selected integer, for example 3, or a non-integer, for example 3.5.

The implementor of the gaming device may predetermine the activators and deactivators or may add another layer of random generation, wherein the present invention randomly selects the activators and deactivators from the set of indicators. In either case, the implementor can set the probability of success for each award to be any probability, 0 through 100%.

If the activators and deactivators are randomly selected and not predetermined, the method randomly selects them by first maintaining or storing a predetermined activation probability and deactivation probability for or associated with each award. Second, the present invention also maintains the indicator set described above. When the time comes for randomly generating the activators and deactivators for an award, the controller of the present invention recalls the stored probabilities and indicator set from memory. The controller then uses the recalled items in a mathematical equation to determine the number of activators and the number of deactivators. That is, the controller multiplies the probabilities by the number of indicators and determines a number of activators and deactivators.

Knowing the number of activators and deactivators, the present invention randomly selects the respective plurality of activators and deactivators from the indicator set. At this point the present invention proceeds in the same manner as before, wherein the activators and deactivators are predetermined. That is, the gaming device randomly selects an indicator and determines the player's outcome by identifying whether the plurality of activators or the plurality of deactivators contain the selected indicator. This embodiment contains two layers of random determination.

After selecting an indicator from the indicator set for each award, and determining, for each award, whether the player receives the award's value, the gaming device employing the present method accrues all the rewards that the player receives to form a total value. The total value can be a multiplier, which the gaming device multiplies by the player's bet, or a number of credits, which the gaming device adds to the player's credit total. The present invention contemplates setting a threshold level that the total value must exceed before the bonus round can end, so that the player receives more than lower limit, for example, a 2× multiplier or 5 credits.

In one embodiment of the present invention, the gaming device contains a display showing a simulated slot machine and a number of coins. The number of coins equals the number of awards, and a number on each coin represents the value of the award. The indicators could be the set of numbers 0 though 9 for each award or coin. Upon a bonus round triggering event, the controller selects an indicator for each award. If the activators (predetermined or otherwise) include the indicator, the player receives the award displayed on the respective coin. Alternatively, If the deactivators (predetermined or otherwise) include the indicator, the player does not receive the award displayed on the respective coin. After selecting an indicator for and determining if the player receives the value of each coin, the gaming device displays the player's total win or value for the round (sum of the coin values, which preferably are multipliers), the player's bet (in credits) and the round's total award (value times the bet equaling a number of credits).

It is therefore an object of the present invention to provide a gaming device that has a method for randomly generating a bonus round outcome.

Another object of the present invention is to provide a method for randomly generating a bonus round outcome that enables the implementor of the gaming device to predetermine the probability that a player will achieve a particular bonus outcome.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 4 is a table illustrating value and probability components of the present invention, which are used to determine the player's award;

FIG. 5 is a table illustrating value and probability components of the present invention, which are used to determine the player's award;

FIG. 6A is a table illustrating a random generation of integer numbers, which are used to determine the player's award;

FIG. 6B is a table illustrating a random generation of non-integer numbers, which are used to determine the player's award;

DETAILED DESCRIPTION OF THE INVENTION

Gaming Device and Electronics

Figure 1:
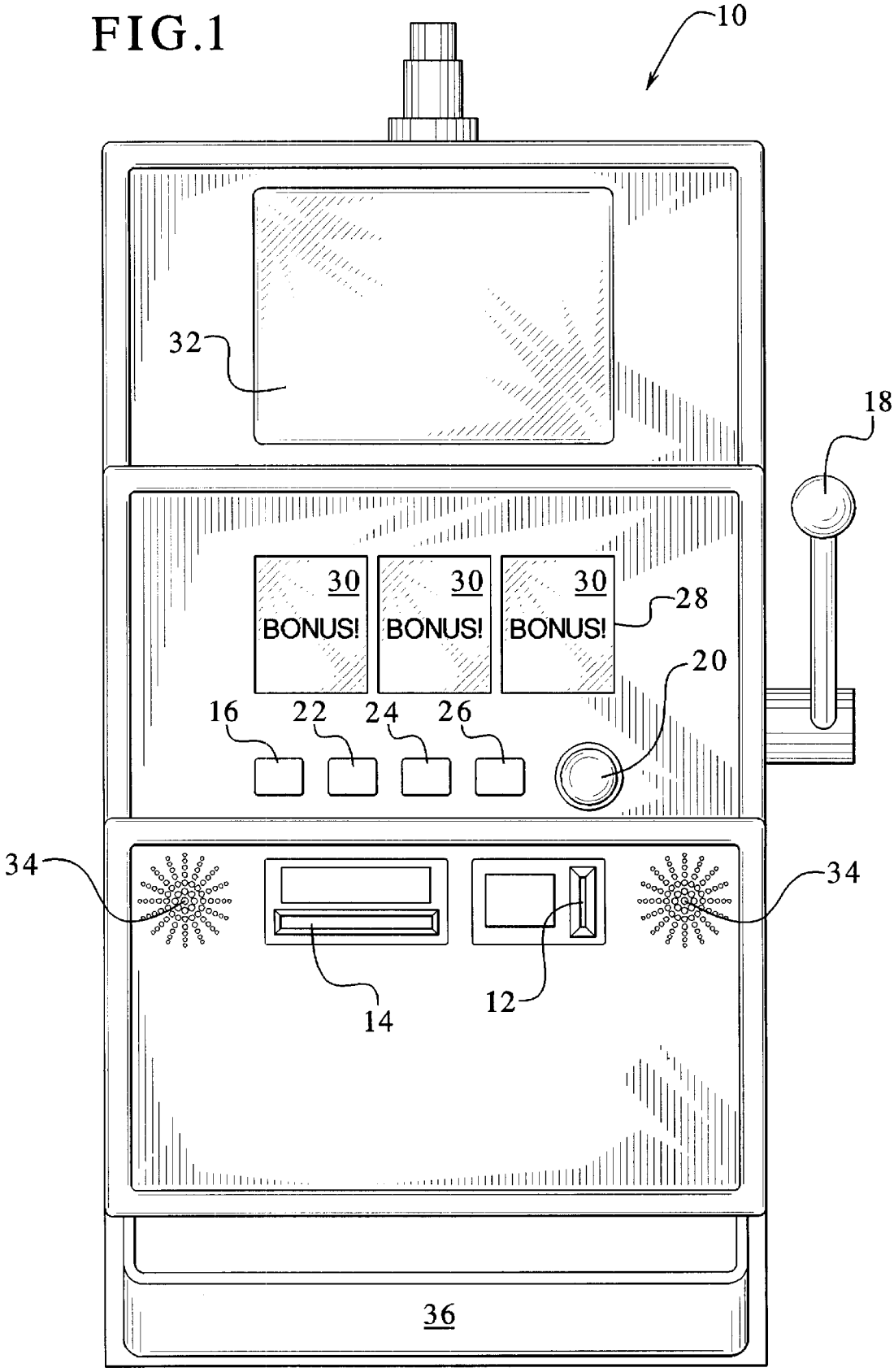
FIG. 1 is a front elevational view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any game such as slot, poker or keno in addition to any of their bonus triggering events which trigger the bonus scheme of the present invention. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18, pushing play button 20. Play button 20 can be any play activator used by the player which starts any game or sequence of events in the gaming device.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at video monitor 32 instead of at display window 28. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards which keep track of the player's credits.

Figure 2:
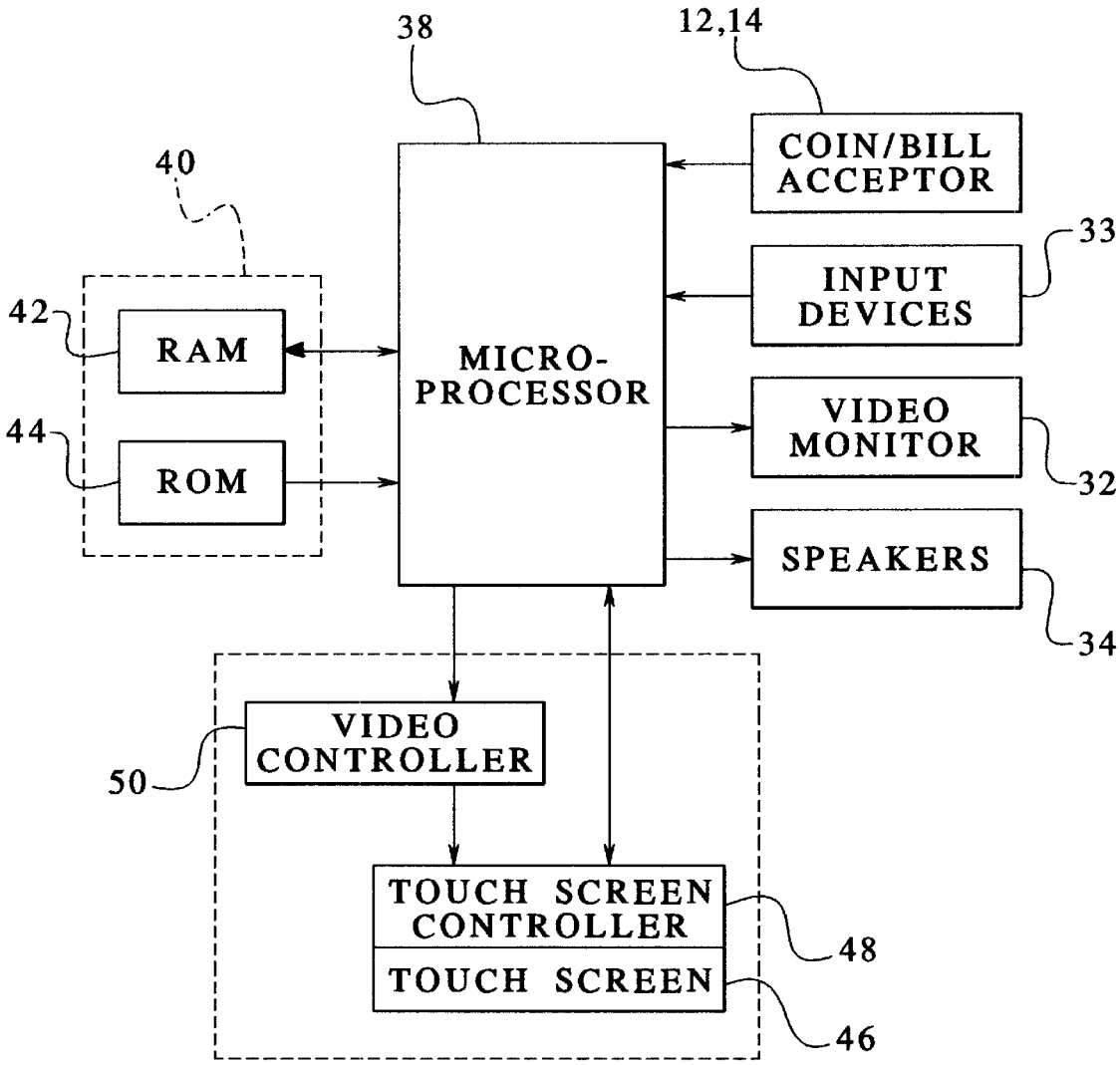
FIG. 2 is a schematic block diagram of the electronic configuration of one embodiment of the gaming device of the present invention.

With respect to electronics, the controller of gaming device 10 preferably includes the electronic configuration generally illustrated in FIG. 2, which has: a processor 38; a memory device 40 for storing program code or other data; a video monitor 32 or other display device (i.e., a liquid crystal display); a plurality of speakers 34; and at least one input device as indicated by block 33. The processor 38 is preferably a microprocessor or microcontroller-based platform which is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game rules and pay tables.

As illustrated in FIG. 2, the player preferably uses the input devices 33, such as the arm 18, play button 20, the bet one button 24 and the cash out button 26 to input signals into gaming device 10. Furthermore, it is preferable that touch screen 46 and an associated touch screen controller 48 are used instead of a conventional video monitor 32. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. For purposes of describing the invention, the controller includes the processor 38 and memory device 40.

With reference to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on the display window 28. The gaming device 10 also includes a display device such as a video monitor 32 shown in FIG. 1 enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Bonus Scheme Apparatus

Figure 3:
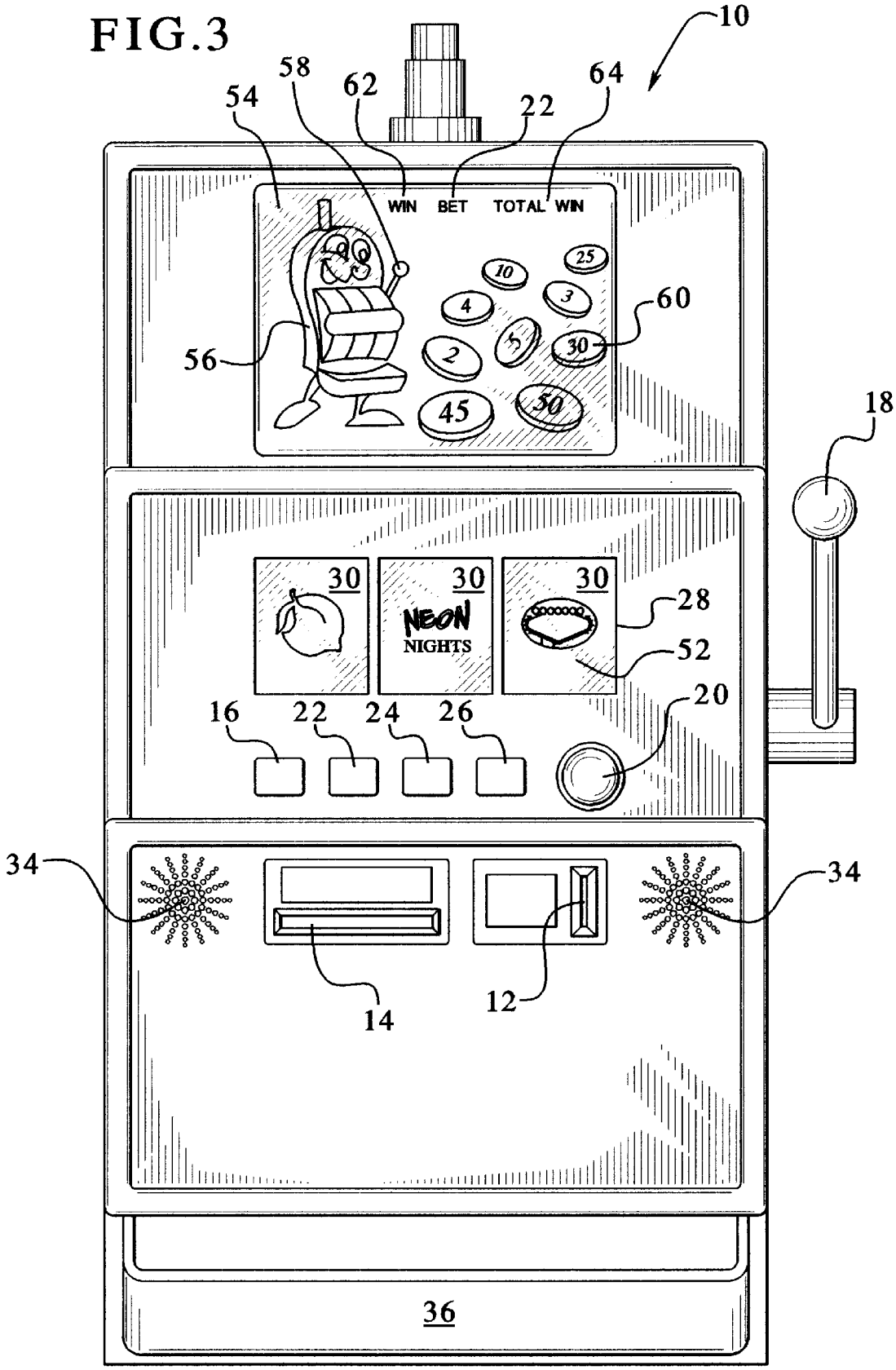
FIG. 3 is a front elevational view of the gaming device and one embodiment of the bonus scheme of the present invention.

FIG. 3 shows a front view of one embodiment of the gaming device having the bonus scheme us of the present invention. If a player achieves a bonus triggering or qualifying condition while playing the game, the gaming device 10 automatically begins the bonus round of the present invention. In this embodiment, the bonus triggering or qualifying condition is a designated symbol, i.e. the Las Vegas symbol 52, on one of the reels as shown in FIG. 3. It should be appreciated that the present invention could employ any symbol or combination of symbols. Further, the present embodiment could be one of a plurality of bonus games associated with a master bonus game, wherein the gaming device 10 randomly selects one of the bonus games upon the triggering event.

To enhance player excitement and enjoyment, when the designated symbol 52 appears, the game preferably provides a bonus scheme initialization with suitable audio and visual signals to inform the player that a symbol or a combination of the reels 28 has invoked the bonus round. For example, the game could maintain a blank video monitor 32 until the bonus round begins, wherein the monitor flashes suitable video signals before presenting a bonus round screen 54 in video monitor 32.

The bonus screen 54 preferably has a theme. In this embodiment, the theme includes a slot machine 56 having an arm 58, although the invention contemplates providing any suitable theme. The player initiates the bonus round by pressing the area of the bonus screen 54 having the slot machine arm 58. In this embodiment, at least a portion of video monitor 32 includes a touch screen 46 as described in FIG. 2. Preferably, the game provides some prompting or indication to the player to press the slot machine arm 58 to start the round. For example, the game could initially illuminate the arm or provide a suitable message. It should be appreciated that the present invention contemplates providing a separate electro-mechanical button, like play button 20, which initiates the bonus round.

The invention contemplates providing a plurality of symbols 60, wherein each symbol represents an award, as described below. The symbols preferably correspond to the theme of the bonus scheme. In this embodiment, the theme includes a slot machine and appropriately, the symbols include a plurality of coins. The symbols also preferably display a value associated with each award, described below. In this embodiment, the symbols 60 show values of 2, 3, 4, 5,10, 25, 30, 45 and 50.

The invention contemplates highlighting individual symbols at different stages of the bonus round. For example, this embodiment highlights different symbols sequentially for a predetermined period of time after the player presses the arm 58 to indicate that the machine is "thinking" of the player's award. Also, the game displays the player's total award by highlighting the winning symbols at the end of the bonus round. In this embodiment, the game highlights the symbols 60 by illuminating them. The invention contemplates other suitable alternatives, for example, by having a blank screen beside the slot machine, and only displaying the symbols 60 at the times described above.

The present invention also contemplates displaying a bonus round win display 62, bet display 22, and total win display 64. The video monitor 32 displaying the bonus screen 54 preferably includes the above displays, although they could be separate. The win display 62 shows the accumulated values of the symbols 60 at the end of the bonus round. In this embodiment, the values represent multipliers. The multipliers are preferably multiplied by a player's bet shown in the bet display 22 to achieve a total win for the bonus round shown in the total win display 64. Alternatively, the values represent a number of credits, shown in the win display 62, and a second credit display 16 in screen 54 shows the player's total updated number of credits after the bonus round.

The gaming device of the present invention also includes data stored in the memory device 40 and accessed by the processor 38 as illustrated by FIGS. 4, 5, 6A and 6B. FIG. 4. is a table having the data necessary to provide a single layer of random generation. The column furthest to the left contains a plurality of awards 66, each award having a value 68. An award 66 can have any value 68, such as 50, and two or more awards may have the same value. FIG. 4 shows the values increasing as the rows proceed downward. The invention contemplates the values increasing or decreasing from row to row as desired by the implementor. The values contained in the table of the present invention preferably match, one for one, with the values displayed on the symbols 60 in FIG. 3. The remainder of the table of FIG. 4 contains data necessary to randomly determine whether the player receives the above described value.

The column to the right of the awards contains a plurality of sets, wherein each set contains a plurality of indicators 72. The indicators 72 define a set of possible selections. Each award 66 has its own set of indicators 72, which can vary or be the same as the sets associated with other awards. The indicators 72 are preferably consecutive. For example, FIG. 4 shows each award having the indicators 0, 1, 2, 3, 4, 5, 6, 7, 8 and 9. Alternatively, the indicators can be non-consecutive. For example, the indicators could be 0, 2, 4, 6, 8, 10, 12, 14, 16, 18 and 20. If the indicators are consecutive, the present invention can limit the processor's choice to integers, or include any-non-integer value, such as 4.26, that lies within the lowest and highest values of the consecutive integers. Preferably, the lowest and highest values of the plurality are selectable. For example, in a range of 2 to 7, the present invention can select either 2 or 7.

The column to the right of the indicators 72 contains a plurality of activators 74 for each award 66. The activators 74 can include any number of the indicators 72. In one embodiment, the implementor predetermines which indicators are activators. In another, the game randomly selects the activators from the indicators. The activators 74 define a number of possible winning selections from the indicators 72. That is, if the game generates an indicator that is on the activators, the player receives the award. Like the indicators, the activators 74 can be consecutive or non-consecutive. For example, FIG. 4 shows awards having the activators 0, 1, 2 or 3. Alternatively, the activators can be non-consecutive. For example, the activators could be 1, 3, 5 and 7 as shown in the seventh row from the top of FIG. 4. If the activators are consecutive, the present invention can include only integers, or alternatively, include any non-integer value that lies within the lowest and highest values of the consecutive integers. Preferably, the processor 38 includes the lowest and highest values of the plurality of activators when determining whether the player will receive an award's value. For instance, if a plurality of activators for a given award is 2 to 7, and the game selects the indicator to be 7, then the player receives the award because the activators include the selected indicator.

The column to the right of the activators 74 contains a plurality of deactivators 78 for each award 66. The deactivators 78 generally have the same attributes as the activators 74; however, the deactivators produce a different outcome than do the activators. That is, a player will not receive an award when the selected indicator is one of the deactivators. Preferably, each set of deactivators 78 contains all the indicators of the set 72 that are not activators 74. Alternatively, a set of deactivators 78 may contain less than all the indicators that are not activators. The deactivators 78 can include any number of the indicators 72. In one embodiment, the implementor predetermines which indicators are deactivators. In another, the game randomly selects the deactivators from the indicators.

FIG. 5. is a table having the data necessary to provide two layers of random generation. FIG. 5. shows the awards 66, the indicators 72, the activators 74, and the deactivators 78, described above. To provide the second layer of random generation, the present invention requires a predetermined activation probability 70 and a deactivation probability 76 for each award.

In FIG. 5, the column to the right of the awards 66 contains a plurality of activation probabilities 70. The activation probabilities can span from 0 to 100%. The activation probabilities can have a mathematical relationship with the values 68 of the awards 66 (e.g. the lower the values, the higher the activation probability, which equates to a higher probability that the player receives the award). Alternatively, the probabilities can have no relationship with the values of the awards and be arbitrarily assigned. Preferably, the bonus scheme employs a mix as shown in FIG. 5. For example, FIG. 5 shows the activation probability 50% assigned to two awards, one having a value of 5X, the other having a value of 25X. Likewise, a 30% activation probability is assigned to a 3X value and a 45X value.

The column to the right of the of the activators 74 contains a plurality of deactivation probabilities 76. The deactivation probabilities 76 generally have the same attributes as the activation probabilities 70; however, the present invention employs activation probabilities 70 to generate a number of activators 74 and deactivation probabilities 76 to generate a number of deactivators 78. Each deactivation probability 76 is preferably equal to 100% less the activation probability 70. Alternatively, the deactivation probability could be less than that amount. The different uses for the activation and deactivation probabilities are described below.

FIGS. 6A and 6B show tables having the awards 66 and the values 68, such as 50, from FIGS. 4 and 5 and a column of selected indicators 80. In both the single and double generation embodiments, one layer of generation occurs when the processor 38 randomly selects an indicator 80 for each award 66 from the award's set of indicators 72. FIG. 6A shows the selected indicators 80 after the processor has selected integers selection for each award 66. FIG. 6B shows the selected indicators 80 after the processor has selected non-integers for each award.

Before describing the embodiments of the invention, it should be appreciated that the embodiment chosen to illustrate the invention chooses whether or not to award the player one or more awards from a set of awards. In a much broader sense, the present invention selects an outcome from a plurality of outcomes. The present invention can choose from any desired type of outcomes according to the game theme, whether the present invention is employed as a stand alone game or as part of master game or multi-layered game or for any other suitable reasons. Again, the outcomes in this embodiment are whether the player receives an award value or does not receive an award value. In other games, the present invention contemplates deciding between two or more values. In a bonus scheme having a plurality of bonus games, the present invention contemplates choosing one of the plurality of bonus games. In a multi-layered bonus scheme, the present invention contemplates determining whether a player advances to another bonus layer. The present invention contemplates choosing an outcome from any number of possible outcomes and having the outcome perform any suitable task.

Single Random Generation Embodiment

Figure 7A:
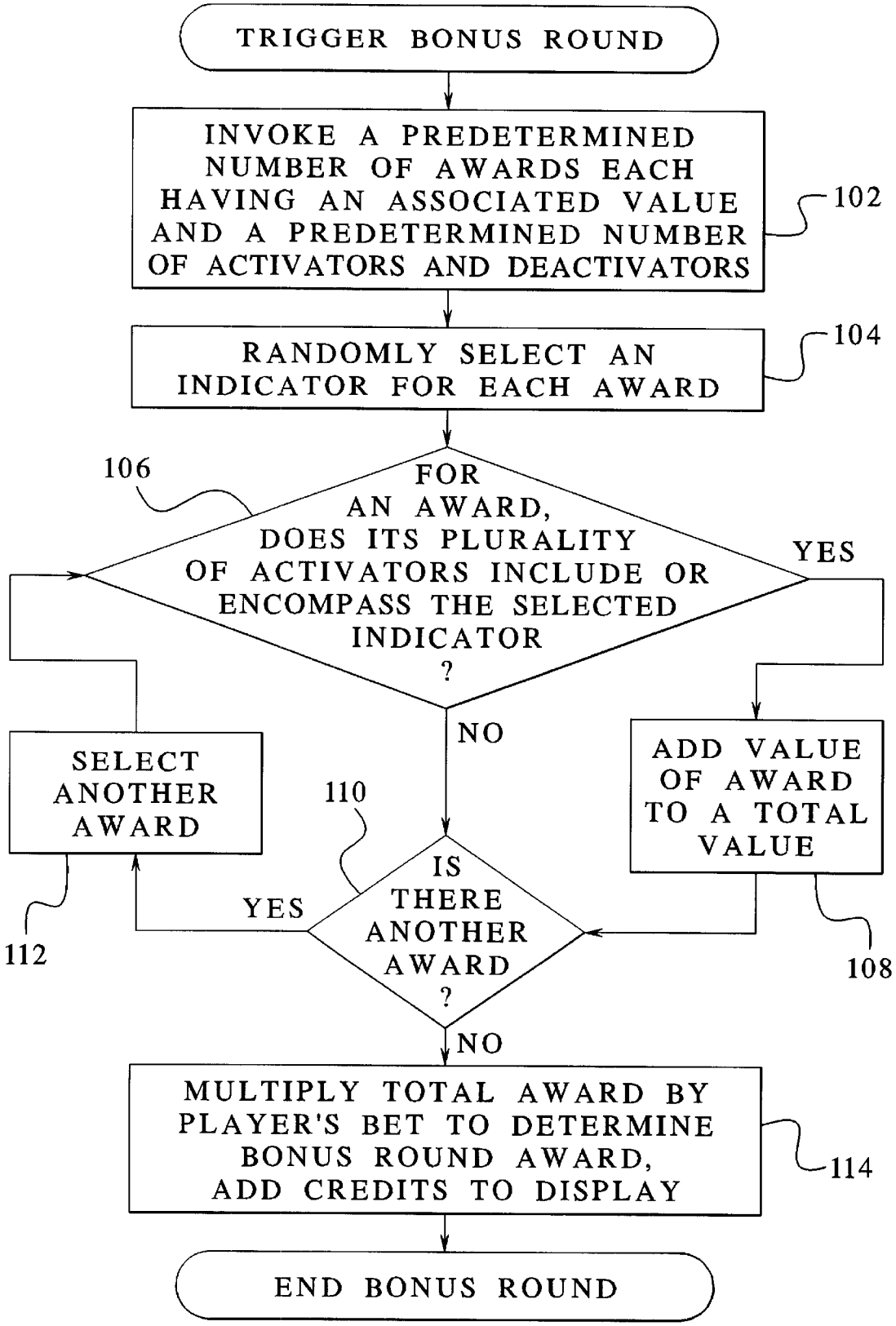
FIG. 7A is a flowchart of one embodiment of the present invention.

In one embodiment of the present invention illustrated by FIG. 7A, the method contains one layer of random generation. The method does not employ the activation probabilities 70 or the deactivation probabilities 76. The implementor predetermines the values 68, the activators 74, the deactivators 78, and the indicator set 72 for each award 66 and stores them in the memory device 40. Referring to FIG. 7A, upon a bonus round triggering event, the gaming device employing the present method invokes a database from the memory device 40 as indicated by block 102. The database contains a predetermined number of awards, each having an associated value 68, a number of activators 74, a number of deactivators 78, and an indicator set 72. The processor 38 randomly selects an indicator 80 from the indicator set 72 for each award as indicated by block 104.

Beginning with a first award, the processor 38 compares whether the plurality of activators 74 includes the selected indicator 80 as determined in diamond 106. If the indicator set includes only integers, then the comparison will involve whether one of the activators 74 equals the selected indicator 80. For example, referring to FIGS. 4 and 6A, the top row shows a plurality of activators, 0, 1, 2 and 3. If the selected indicator is 0, 1, 2 or 3, then the player receives the value 68 of the award 66. FIG. 6A shows the selected value 80 for the top row to be 7. The player does not receive the value because 7 is not equal to 0, 1, 2 or 3. It should be appreciated that for non-sequential activators 74 (e.g., for the sixth through the ninth rows from the top in FIG. 4), the bonus scheme must use the integer embodiment.

The present invention also contemplates including non-integer values when the plurality of indicators, activators and deactivators are sequential. If so, the comparison will involve whether the lowest and highest values in the activator range 74 encompass the selected indicator 80. For example, FIG. 6B displays a plurality of non-integer selections. The second award row of FIG. 4 displays the activators 0, 1 and 2. In a non-integer embodiment comparison, if the lowest and highest activators, 0 and 2 respectively, encompass the selected indicator 80 of FIG. 6B, then the player receives the value 68 of the award 66. FIG. 6B shows the selected value 80 of the second award row to be 1.5. 0 and 2 encompass 1.5, therefore, the player receives the value, a 3X multiplier.

As indicated by block 108, if the plurality of activators includes or encompasses the selected indicator, the game awards the player the value of the award. The present invention keeps track of a total value, which is displayed in the win display 62 of FIG. 3. The total value is the summation of individual values that the bonus scheme awards to the player during a round. After selecting an indicator and making a comparison, the bonus scheme determines in diamond 110 whether another award exists. If another award exists, then the bonus scheme selects another award as indicated by block 112 and makes the comparison determined in diamond 106.

If another award does not exist, as determined in diamond 110, then the bonus scheme has analyzed each award and has determined a total value for the bonus round. As described above and indicated by block 114, if the total value is a multiplier, the scheme multiplies the total value by the player's bet to determine a number of award credits and adds the credits to the player's total. Otherwise, if the total value represents a number of credits, the bonus scheme simply adds the credits to the player's total.

Figure 7B:
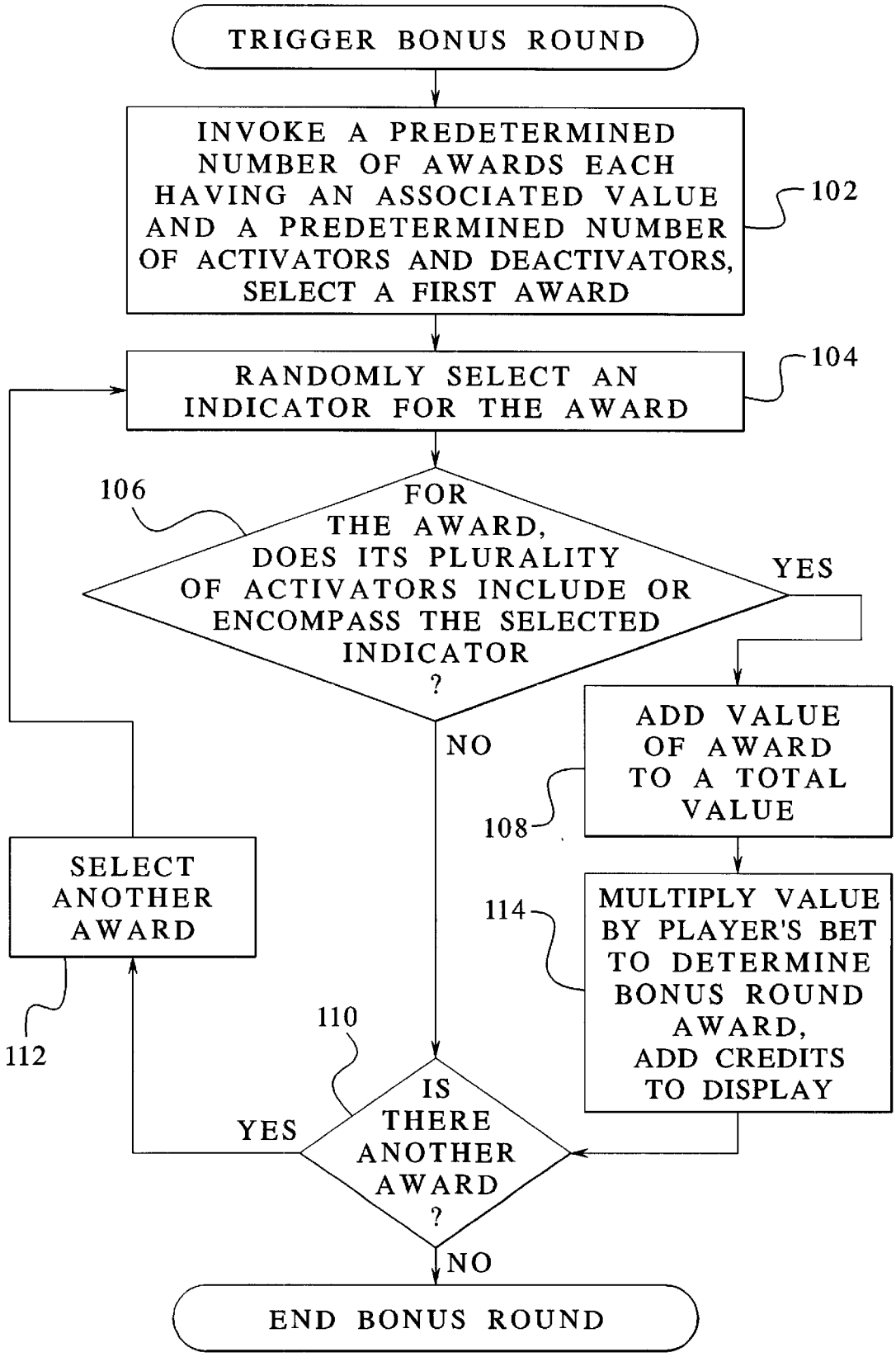
FIG. 7B is a flowchart of another embodiment of the present invention.

It should be appreciated that the invention contemplates carrying out the invention in a plurality of configurations. In essence, the present invention can analyze the data contained in FIGS. 4, 5, 6A and 6B row by row (award by award) or column by column or a combination thereof. FIG. 7B shows the method of FIG. 7A employed differently. Here, instead of randomly selecting all the indicators 80 at once as shown in block 104 of FIG. 7A, the processor selects indicators 80 for an award as shown in block 104 of FIG. 7B, makes the activator comparison as determined in diamond 106, updates the total award value as indicated by 108 and updates the player's credits as shown in block 114 before determining if another award exists as determined in diamond 110. If another award does exist, the method of FIG. 7B selects an indicator for the next award as indicated by block 104. Alternatively, in the method of FIG. 7A, the game returns to the activator comparison indicated by diamond 106. Both the FIG. 7A and 7B embodiments produce the same outcome. The implementor may select any embodiment to maximize processing speed, programming ease, or for any other suitable reason.

Figure 7C:
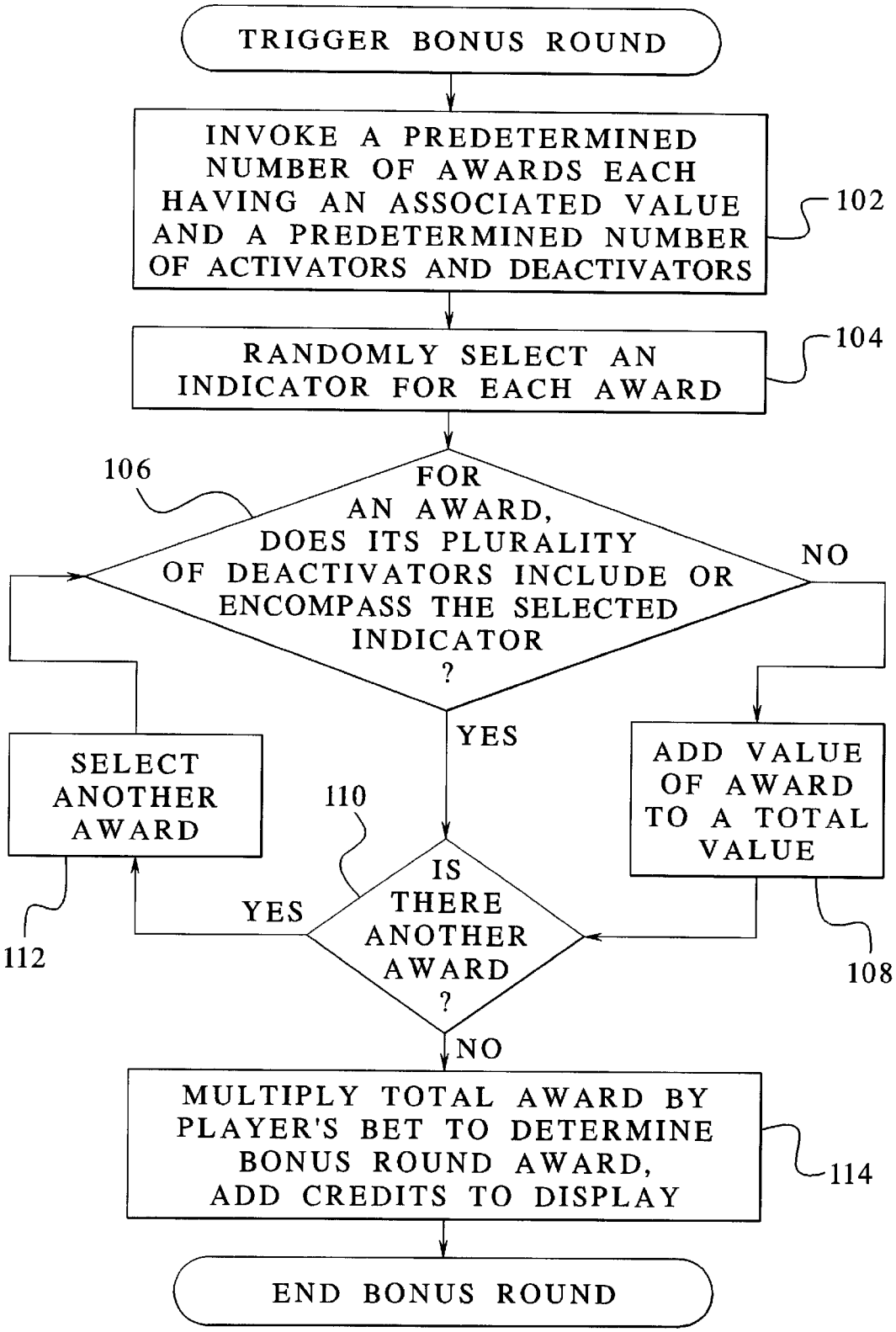
FIG. 7C is a flowchart of another embodiment of the present invention.

In an alternative embodiment shown in FIG. 7C, diamond 106 employs deactivators instead of activators. As discussed above with respect to block 102, upon a bonus round triggering event, the gaming device invokes a database containing a predetermined number of awards, each having an associated value 68, a number of activators 74, and a number of deactivators 78. In the deactivator embodiment, the bonus scheme determines whether the plurality of deactivators includes the selected indicator 80. If not, then the scheme adds the value of the award to a total value as shown in block 108. If the deactivators include the selected value, the scheme does not award the value.

The deactivator embodiment otherwise operates the same as the activator embodiment. For example, the deactivator embodiment includes the integer and non-integer embodiments. The deactivator embodiment can also employ the configuration discussed in connection with FIG. 7B.

The present invention contemplates providing the player a second chance or multiple second chances if the total value equals or falls below a threshold level. The implementor can set the threshold level to be any total value, even zero, regardless of whether the value represents a multiplier or a number of credits. For example, if the implementor sets the threshold at a 3X multiplier and the player obtains only a 2X, the method resets the bonus round, which randomly generates a new total value. Preferably, the game resets itself until the player achieves a total value above the threshold. Preferably, the player does not receive a lower total value than previously obtained. In each of the embodiments described above, the present invention makes the determination after determining that no more awards exist as shown in diamond 110 and resets itself to randomly select the indicators as indicated by block 104.

In one example, the present invention enables the player to play the bonus round after the player receives the Las Vegas symbol 52 in the base game of gaming device 10. The player begins by pressing the slot machine arm 58 on the touch screen 46 of the video monitor 32 displaying the screen 54. When the player presses the arm 58, the bonus scheme begins to randomly select indicators 80 as indicated by block 104. Preferably, the bonus scheme shows the player that it is thinking by randomly and sequentially illuminating the symbols 60.

The scheme randomly selects the 7, 1, 2, 7, 5, 4, 9, 5 and 0 as shown in FIG. 6A. Employing the activator embodiment, the player receives the 3X, 10X, 25X and 45X for a total value of 83X, and the corresponding symbols in screen 54 remain illuminated. The result is the same employing the deactivator embodiment, wherein the player does not receive the 2X, 4X, 5X, 30X and 50X. Preferably, the present method either employs the activator or deactivator embodiment in any given bonus round, but not both. The present invention contemplates providing both integer and non-integer embodiments in a single bonus round. That is, the present invention can choose indicators such as those shown in FIG. 6B when the activators and deactivators are sequential and choose indicators such as those in FIG. 6A when the activators and deactivators are non-sequential.

Dual Random Generation Embodiment

Figure 8:
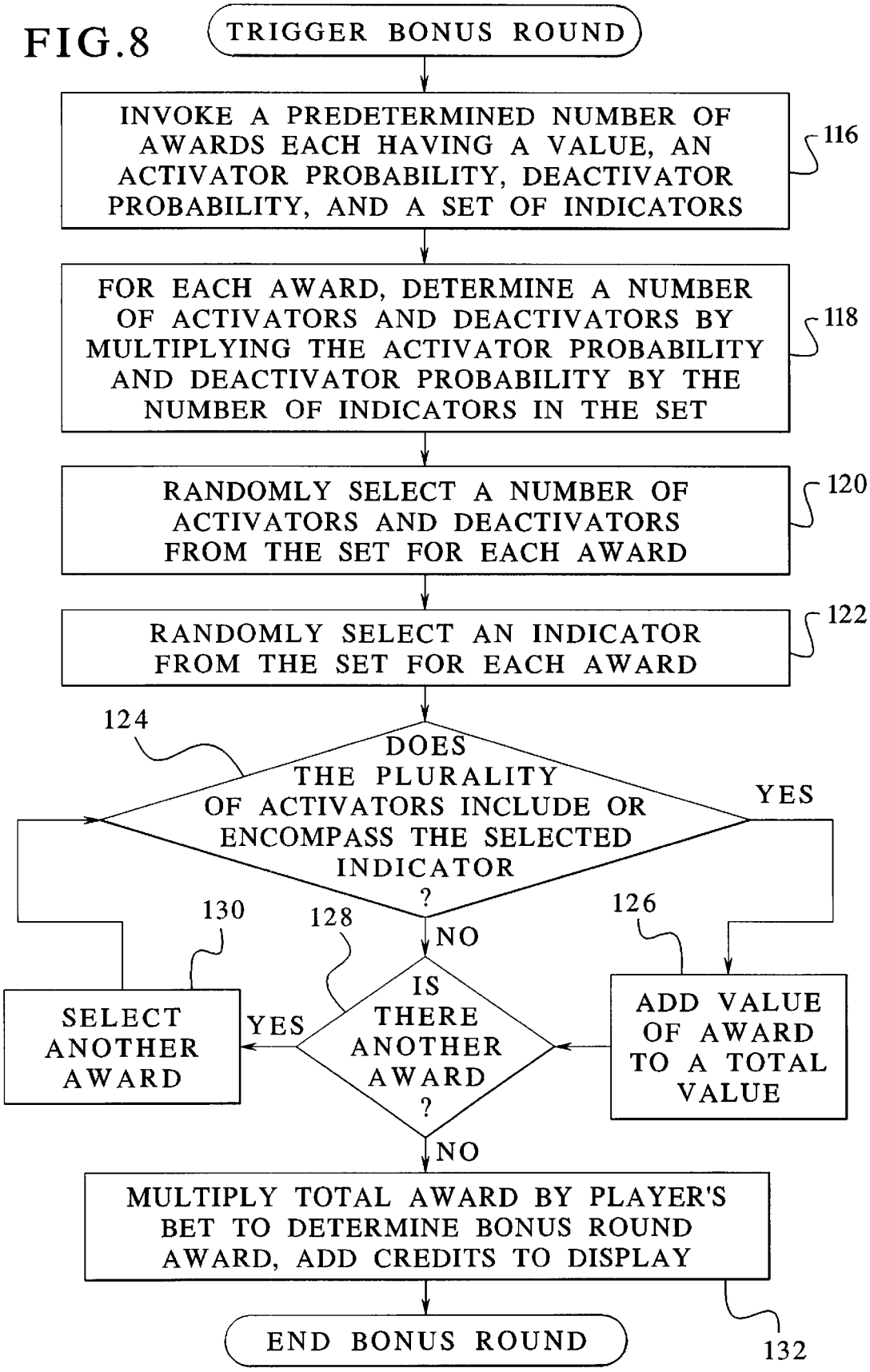
FIG. 8 is a flowchart of another embodiment of the present invention.

In another embodiment of the present invention illustrated in FIGS. 5 and 8, the method contains two layers of random generation. This method employs the activation probabilities 70 and the deactivation probabilities 76. Upon a bonus round triggering event, the gaming device employing the present method invokes a database from the memory device 40 as indicated by block 116. The database contains a predetermined number of awards 66, each having an associated value 68, an activation probability 70, a deactivation probability 76, and a set of indicators 72. For each award, the processor 38 calculates a number of activators by multiplying the award's activation probability 70 by the number of indicators 72 and a number of deactivators by multiplying the award's deactivation probability 76 by the number of indicators 72 as indicated by block 118.

In the first layer of random generation, indicated by block 120, the processor 38 randomly selects the previously determined number of activators 74 and deactivators 78 from the set of indicators 72 for each award. In the second layer of random generation, the processor 38 randomly selects an indicator 80 from the indicators 72 for each award as indicated by block 122. After this point, the dual generation embodiment operates the same as the single layer embodiment Beginning with a first award, the processor 38 compares whether the plurality of activators 74 includes the selected indicator 80 as determined in diamond 124. As indicated by block 126, if the plurality of activators includes the selected indicator, the game awards the player the value of the award. In diamond 128, the game determines whether another award exists. If another award exists, then the bonus scheme selects another award as indicated by block 130 and makes the comparison determined in diamond 124. If not, the game updates the player's credits as displayed by block 132.

The dual layer embodiment also contains the alternative embodiments of the single layer embodiment. For example, the total value can be a multiplier, or it can represent a number of credits. Second, the embodiment contemplates performing any of the following functions on an award by award basis: (i) calculating the number of activators and deactivators as indicated by block 118; (ii) randomly selecting the activators and deactivators as indicated by block 120; (iii) randomly selecting the indicators as indicated by block 122; and (iv) determining the bonus round award and updating the player's credit display as indicated by block 132. Third, in diamond 124, the present embodiment can employ deactivators in stead of activators. Fourth, the embodiment contemplates comparing integers and non-integers. Fifth, the embodiment contemplates allowing the player a second chance or multiple second chances if the total value equals or falls below a threshold level.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A method for randomly generating a bonus round outcome in a gaming device, said method comprising the steps of:

(a) triggering said bonus round which includes a plurality of awards, each of said awards having at least one activator associated therewith;

(b) randomly selecting an indicator for each award;

(c) determining for each award if said indicator for said award is included in the activators associated with the award;

(d) displaying and providing to a player a value associated with each award if said indicator for said award is included in the activators associated with said award; and (e) ending said bonus round.

2. The method of claim 1, which includes the step of predetermining the activators.

3. The method of claim 1, wherein said activators are integers, the indicators are integers and determining if said indicator is in the activators includes determining if said indicator equals one of said activators.

4. The method of claim 1, wherein said activators are sequential and determines if said indicator is in the activators includes determining if said activators encompass said indicator.

5. The method of claim 1, which includes displaying a symbol representing each of said awards.

6. The method of claim 5, which includes displaying said value associated with each of said symbols.

7. The method of claim 6, which includes displaying whether said plurality of activators includes said indicator.

8. The method of claim 7, which includes illuminating said symbol.

9. The method of claim 1, which includes determining a bonus round award by multiplying said value by an amount a player has bet.

10. The method of claim 1, which includes providing a value associated with said award if said indicator for said award is not included in deactivators associated with said award.

11. A method for randomly generating a bonus round outcome in a gaming device, said method comprising the steps of:

(a) triggering said bonus round which includes a plurality of awards, each of said awards having an activation probability and a set of indicators associated therewith;

(b) determining at least one activator for each award by multiplying said award probability by the number of indicators in said set;

(c) randomly selecting the number of activators from said set;

(d) randomly selecting an indicator from said set;

(e) determining for each award, if said indicator for said award is included in the activators associated with the award;

(f) displaying and providing to a player a value associated with each award if said indicator for said award is included in the activators associated with the award; and (g) ending said bonus round.

12. The method of claim 11, wherein said activators are integers, the indicators are integers, and the step of determining if said plurality of activators includes said indicator includes determining if said indicator equals one of said activators.

13. The method of claim 11, wherein said activators are sequential, and the step of determining if said plurality of activators includes said indicator includes determining if said indicator is within a range of activators.

14. The method of claim 11, which includes accumulating a total value after awarding said value for each award.

15. The method of claim 14, which includes determining a bonus round award by multiplying said total value by an amount a player has bet.

16. The method of claim 14, which includes repeating steps (c) to (f) if said total value is below a predetermined value.

17. The method of claim 11, which includes determining at least one deactivator for each award by multiplying a predetermined deactivation probability by the number of indicators in said set.

18. The method of claim 17, which includes randomly selecting the number of deactivators from said set.

19. The method of claim 18, which includes awarding a player a value associated with the award if said indicator for said award is not included in the deactivators for the award.

20. A method for randomly generating an outcome in a gaming device, said method comprising the steps of:

(a) providing a predetermined number of outcomes and at least one activator associated with each outcome;

(b) selecting at least one indicator;

(c) determining for each outcome if said selected indicator is one of the activators associated with said outcome; and (d) displaying and providing a player each outcome where the indicator is one of the activators associated with said outcome.

21. The method of claim 20, wherein providing said outcome includes awarding a value.

22. The method of claim 20, wherein providing said outcome includes displaying a bonus game for said player to play.

23. The method of claim 20, wherein providing said outcome includes continuing a bonus game.

24. A gaming device for generating a bonus round outcome comprising:

a plurality of awards;

a value associated with each award;

at least one activator associated with each award;

a set of indicators;

a randomly selected indicator from said set, for each award; and a display device, whereby a player receives said value associated with each award if the selected indicator for said award is one of said activators associated with said award, and said display device displays said values received by the player.

25. The gaming device of claim 24, wherein said activators are predetermined.

26. The gaming device of claim 24, wherein said activators are chosen from said set of indicators.

27. The gaming device of claim 24, wherein said activators are sequential.

28. The gaming device of claim 24, wherein said activators, and indicators are integers.

29. The gaming device of claim 24, which further includes a predetermined activation probability and the number of activators equals said activation probability multiplied by the number of indicators in said set.

30. The gaming device of claim 24, which further includes a plurality of deactivators.

31. The gaming device of claim 30, wherein said number of deactivators is predetermined.

32. The gaming device of claim 30, which includes a predetermined deactivation probability and the number of deactivators equals said deactivation probability multiplied by the number of indicators in said set.

33. The gaming device of claim 24, which further includes a display connected to said controller, wherein said display contains a symbol representing each of said awards.

34. The gaming device of claim 33, wherein said symbol includes the value of said award.

* * * * *

UNITED STATES PATENT AND TRADEMARK OFFICE

CERTIFICATE OF CORRECTION

PATENT NO. : 6,569,016 B1 
DATED : May 27, 2003
INVENTOR(S) : Anthony J. Baerlocher It is certified that error appears in the above-identified patent and that said Letters Patent is hereby corrected as shown below:

Column 1,
Line 33, change “bonus rounds awards” to -- bonus round awards --.

Column 3,
Line 9, change “more than lower limit” to -- more than a lower limit --.
Line 20, change “Alternatively, If” to -- Alternatively, if --.

Column 6,
Line 11, change “bonus scheme us of” to -- bonus scheme of --.

Column 7,
Line 54, change “that is on the” to -- that is one of the --.

Column 8,
Line 52, change “such as 50” to -- such as 50 --.

Column 11,
Lines 53-54, change “embodiment Beginning” to -- embodiment. Beginning --.

Column 12,
Line 10, change “deactivators in stead of” to -- deactivators instead of --.
Line 50, change “sequential and determines” to -- sequential, and determining --.
Line 66, change “included in deactivators” to -- included in the deactivators --.

Column 13,
Line 14, change “award, if said indicator” to -- award if said indicator --.

UNITED STATES PATENT AND TRADEMARK OFFICE

CERTIFICATE OF CORRECTION

PATENT NO. : 6,569,016 B1 
DATED : May 27, 2003
INVENTOR(S) : Anthony J. Baerlocher It is certified that error appears in the above-identified patent and that said Letters Patent is hereby corrected as shown below:

Column 14,
Line 20, change "from said set, for each award" to -- from said set for each award --.
Line 36, change "activators, and indicators" to -- activators and indicators --.
Lines 38 and 47, change "probability and the number" to -- probability, and the number --.

Signed and Sealed this

Fourteenth Day of October, 2003

JAMES E. ROGAN
*Director of the United States Patent and Trademark Office*